US011911675B2

(12) United States Patent
Engler

(10) Patent No.: US 11,911,675 B2
(45) Date of Patent: Feb. 27, 2024

(54) SPORTS TRAINING DEVICE

(71) Applicant: P&P Imports LLC, Santa Ana, CA (US)

(72) Inventor: Peter Engler, Newport Beach, CA (US)

( * ) Notice: Subject to any disclaimer, the term of this patent is extended or adjusted under 35 U.S.C. 154(b) by 0 days.

(21) Appl. No.: 16/225,099

(22) Filed: Dec. 19, 2018

(65) Prior Publication Data

US 2020/0197770 A1 Jun. 25, 2020

(51) Int. Cl.
*A63B 69/00* (2006.01)
*A63B 63/00* (2006.01)

(52) U.S. Cl.
CPC ..... *A63B 63/00* (2013.01); *A63B 69/0002* (2013.01); *A63B 69/002* (2013.01); *A63B 69/0024* (2013.01); *A63B 69/0071* (2013.01); *A63B 69/0095* (2013.01)

(58) Field of Classification Search
CPC ... A63B 63/00; A63B 69/0002; A63B 69/002; A63B 69/0024; A63B 69/0071; A63B 69/0095
USPC ..... 473/422, 438, 447, 446, 476–478, 444, 473/454, 197, 450, 458; D21/303, 635, D21/705, 780, 788; 273/407, 400
See application file for complete search history.

(56) References Cited

U.S. PATENT DOCUMENTS 2,254,986 A * 9/1941 Ziel ..... A63B 69/0002 473/454
2,873,969 A * 2/1959 Ziel ..... A63B 69/0002 473/456
2,922,653 A * 1/1960 O'Brien ..... A63B 63/00 473/197
3,013,801 A * 12/1961 Kirkconnell, Jr. ..... A63B 63/00 473/421
3,195,898 A * 7/1965 Respini ..... A63B 63/00 473/197
3,672,672 A * 6/1972 Rubin ..... A63B 69/0097 473/435
3,986,719 A * 10/1976 Lee ..... A63B 63/00 473/197
4,326,717 A * 4/1982 McClimon ..... A63B 63/00 473/197
4,629,188 A * 12/1986 Mahieu ..... A63B 63/00 273/407
4,781,376 A * 11/1988 Barnes, Sr. ..... A63B 63/06 473/455
4,869,503 A * 9/1989 Grasso ..... A63B 63/00 473/444
4,934,938 A * 6/1990 Orlandi ..... G09B 19/0038 473/444
D321,370 S * 11/1991 Curtis ..... 473/447
5,280,904 A * 1/1994 Rodriguez ..... A63B 24/0021 473/477
D354,992 S * 1/1995 Hinsperger ..... D21/705
(Continued)

FOREIGN PATENT DOCUMENTS

GB 2308074 A * 6/1997 ..... A63B 69/34

*Primary Examiner* — Mitra Aryanpour

(57) ABSTRACT

Innovative apparatuses and methods for a novel training device is provided that includes a base, a frame, a material attached to the frame, wherein the material comprises a non-solid material; and an image affixed to a first side of the non-solid material, wherein the image is viewable on the first side of the non-solid material and viewable on a second side of the non-solid material.

20 Claims, 10 Drawing Sheets

(56) References Cited

U.S. PATENT DOCUMENTS 5,421,586 A * 6/1995 Amram ..... A63B 63/004 273/407
5,573,240 A * 11/1996 Humboldt ..... A63B 63/00 473/454
5,730,442 A * 3/1998 Anderson ..... A63B 71/022 473/197
5,810,363 A * 9/1998 Saunders ..... F41J 1/00 273/400
5,833,234 A * 11/1998 Vavala ..... A63B 69/0097 473/434
6,866,595 B1 * 3/2005 Elder ..... A63B 69/002 473/446
7,198,580 B2 * 4/2007 Elder ..... A63B 69/002 473/446
D579,504 S * 10/2008 Elder ..... D21/621
7,794,337 B2 * 9/2010 Gamboa ..... A63B 69/345 473/438
8,167,743 B1 * 5/2012 Kangas ..... A63B 69/345 473/422
8,366,570 B1 * 2/2013 DeMarco ..... A63B 71/022 473/477
8,579,734 B2 * 11/2013 Stemle ..... A63B 63/007 473/456
8,651,979 B2 * 2/2014 Chen ..... A63B 69/0097 473/435
D709,970 S * 7/2014 Holland ..... A63B 69/0097 D21/705
9,433,841 B2 * 9/2016 Siefker ..... A63B 63/004 473/446
9,586,117 B2 * 3/2017 Freund ..... A63B 69/0097 473/476
9,931,555 B1 * 4/2018 McCoy ..... A63B 69/0071 473/446
10,668,346 B2 * 6/2020 Zoretic ..... A63B 69/002 473/446
2002/0151387 A1 * 10/2002 Henson ..... A63B 63/00 473/446
2004/0259667 A1 * 12/2004 Berdugo ..... A63B 63/004 473/446
2007/0099730 A1 * 5/2007 Driver ..... A63B 69/0002 473/422
2007/0167263 A1 * 7/2007 Elder ..... A63B 69/002 473/446
2009/0181810 A1 * 7/2009 Stephenson ..... A63B 63/004 473/446
2013/0303312 A1 * 11/2013 DeBolt ..... A63B 69/0097 473/446
2014/0045628 A1 * 2/2014 Krohl ..... A63B 63/00 473/446
2014/0302949 A1 * 10/2014 Yeatman ..... A63B 69/34 473/446
2015/0190693 A1 * 7/2015 Gilman ..... A63B 63/06 473/446
2016/0016060 A1 * 1/2016 Goldwitz ..... A63B 69/00 473/446
2016/0082338 A1 * 3/2016 Klett ..... A63B 69/0026 473/446

* cited by examiner

SPORTS TRAINING DEVICE

TECHNICAL FIELD

The invention relates generally to visual training devices, and more specifically for sports training.

BACKGROUND

Sports training devices have increased in popularity over the years. Traditionally, traffic cones or other obstacles were used for players to navigate around or use as targets. However, the small size limited the practical use of the obstacle as players could shoot or step over the cones, or cause the obstacle to easily move from its location causing delay from resetting the training exercise.

Alternatively, game players could stand in the playing field as an obstacle. However, this limited the ability of the player from participating in the training exercise as well as placing them in potentially a dangerous position (e.g., in front of a soccer shooter, etc.). Thus a better solution was needed.

In recent years new training devices have emerged. For example, inflatable training devices, such as inflatable columns or dummies have emerged. In yet other solutions, training devices include complex obstacles that consist of a frame formed into the shape of a human outline. Both of these solutions are not ideal. For example, inflatable training devices are prone to puncture, are typically opaque, can take significant time to inflate and deflate during a training session, and are hard to store. Training devices where the frame is formed into the shape of a human outline can be complex to assemble and manufacture along with other drawbacks. For example, using a frame shaped into the outline of a human does not replicate the imagery of certain players effectively, such as a defender in football wearing shoulder and a helmet as the frame does not show any features other than the outline itself. Thus, there exists a need for an improved training device that can provide a more realistic visual impression to players while retaining the ability to sight obstacles through the training device.

BRIEF DESCRIPTION

The present disclosure provides techniques, devices, and methods for improved training devices that include a base, a frame, and a material, wherein the material is attachable to the frame, and wherein the material comprises a non-solid material (e.g., a mesh organic or synthetic fabric, etc.). Additionally, the training device includes an image on a first side of the non-solid material, wherein the image is viewable on the first side of the non-solid material and the image is viewable on a second side of the non-solid material.

Other features of the present disclosure will be more readily apparent from the accompanying drawings and from the details descriptions that follows.

BRIEF DESCRIPTION OF THE DRAWINGS

The current innovations are illustrated by way of example in the figures that follow and do not serve to limit the invention to the disclosed embodiments, but rather provide a basic understanding of the innovations herein to one of ordinary skill in the art. Like references may be used to indicate similar, but not always identical, elements in which.

DETAILED DESCRIPTION

Figure 1:
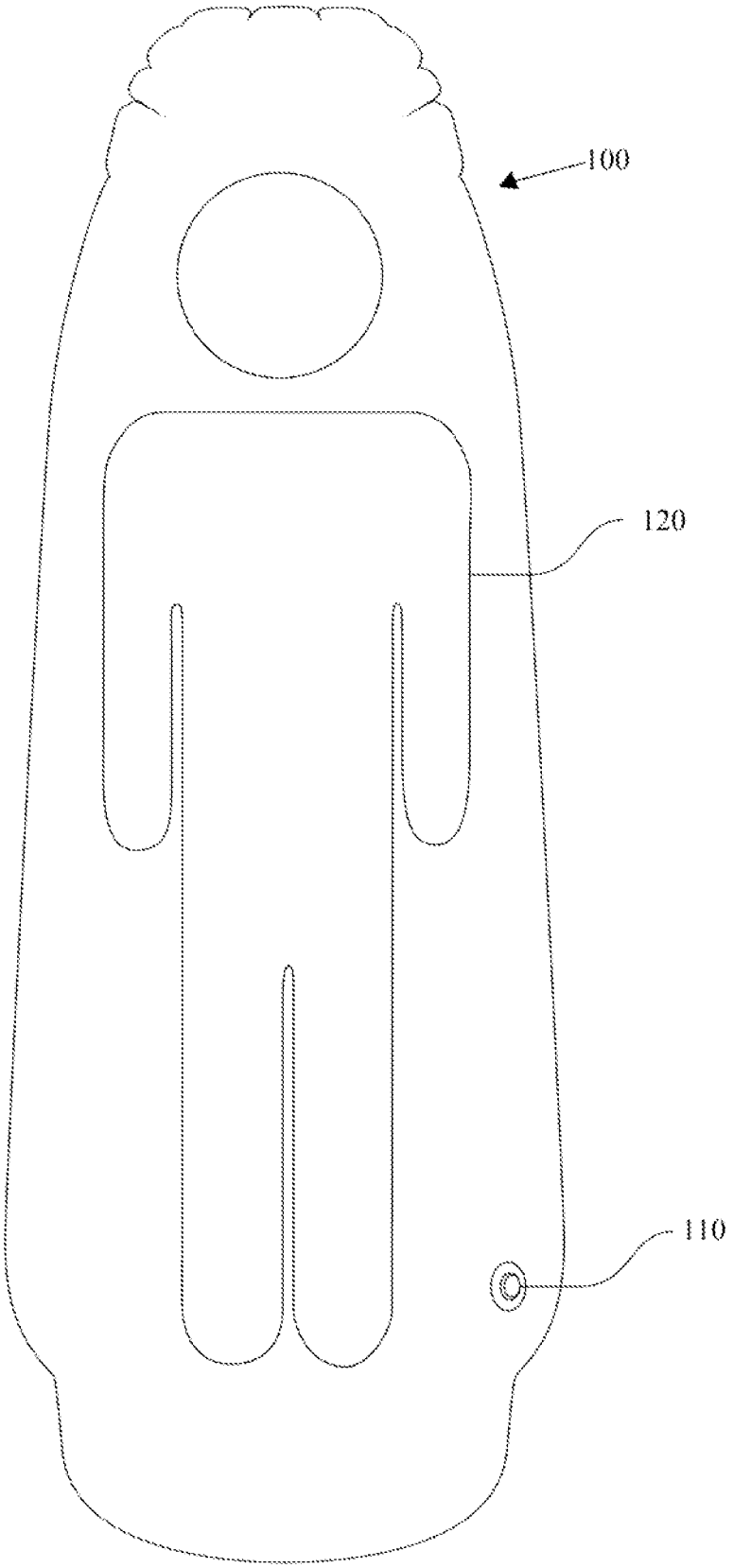
FIG. 1 is an inflatable training device.

FIG. 1 shows an inflatable training device 100. Inflatable training device 100 is typically inflated though a valve 110. It will be appreciated that inflatable training device 100 does not have a frame. Inflatable training device 100 may be constructed by gluing or welding together one or more pieces of air-tight solid material (e.g., plastic, PVC, vinyl, etc.) to form an air-tight training device capable of being filled with a gas (e.g., air, human breath, etc.). Training device 100 uses an opaque material so that it may be seen. It will be appreciated that inflatable training device 100 remains in a substantially vertical position, such as shown in in FIG. 1, on its own, or using a means to secure it to the ground (e.g., sand placed in the bottom of inflatable training device 100, using tie-downs, etc.). Inflatable training device 100 is typically blank, but may include an image, such as image 120 on the front of the inflatable training device. In certain aspects, a second image (not shown) may be included on the back of the inflatable training device. It will be appreciated that, when an observer is viewing the back of the inflatable training device, image 120 on the front of inflatable training device 100 is not visible to the observer, as the material is both solid and opaque.

Figure 2:
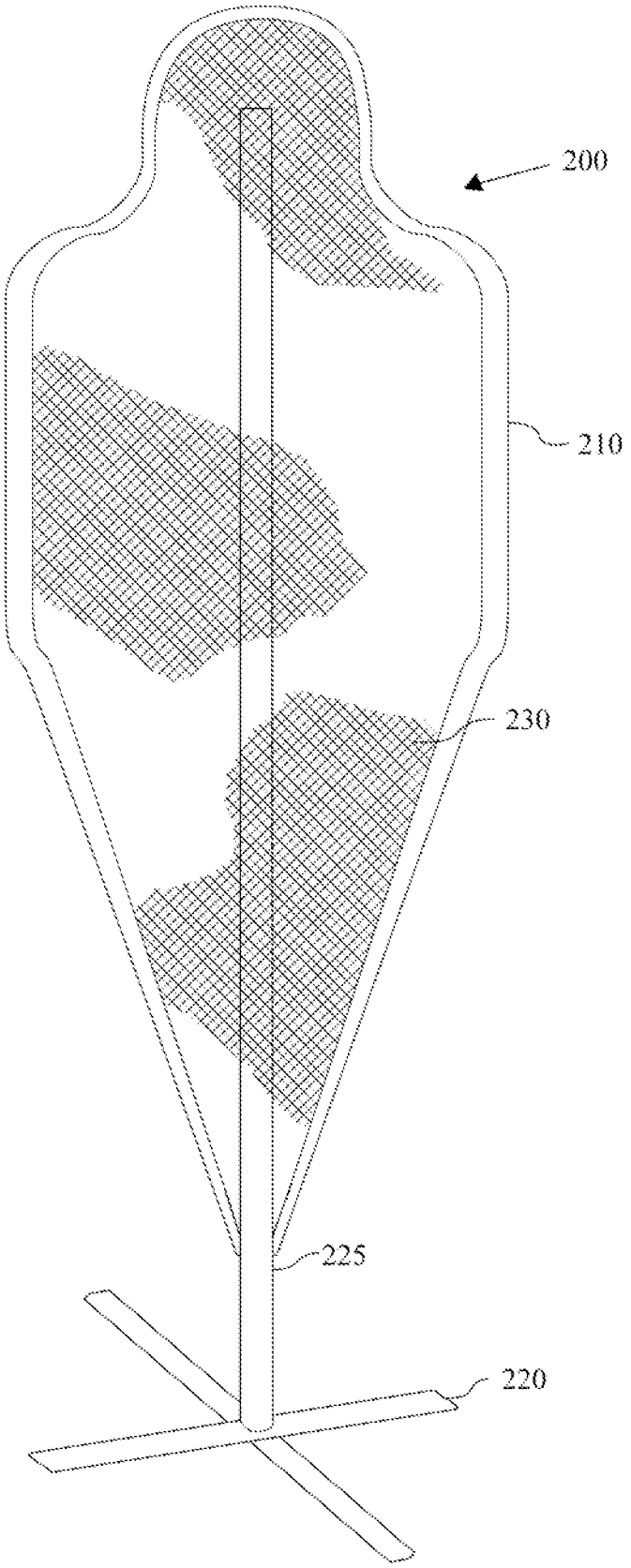
FIG. 2 is a mesh training device.

FIG. 2 shows a training device 200. Training device 200 consist of a frame 210 formed to generally resemble the outline of a human. In certain aspects, frame 210 generally forms the shape of a human, which consists of a head portion, a body portion, and a leg portion. In certain aspects, a head portion, a body portion, and a leg portion may each be formed with their own frame (not shown). Frame 210 is supported by a base 220. In training device 200, the base connects to a supporting member 225, which is used to support and connect to frame 210. A non-solid material 230 (e.g., a net) is shown disposed between the frame elements 210. It will be appreciated that to more accurately provide the profile of a certain type of human (e.g., a football player, etc.), more extensive framing would be needed, increasing the cost and complexity of training device 200. It will be further appreciated that internal (i.e., non-profile) features, such as a face, are not portrayed as they are not part of the outline (or profile).

Figure 3:
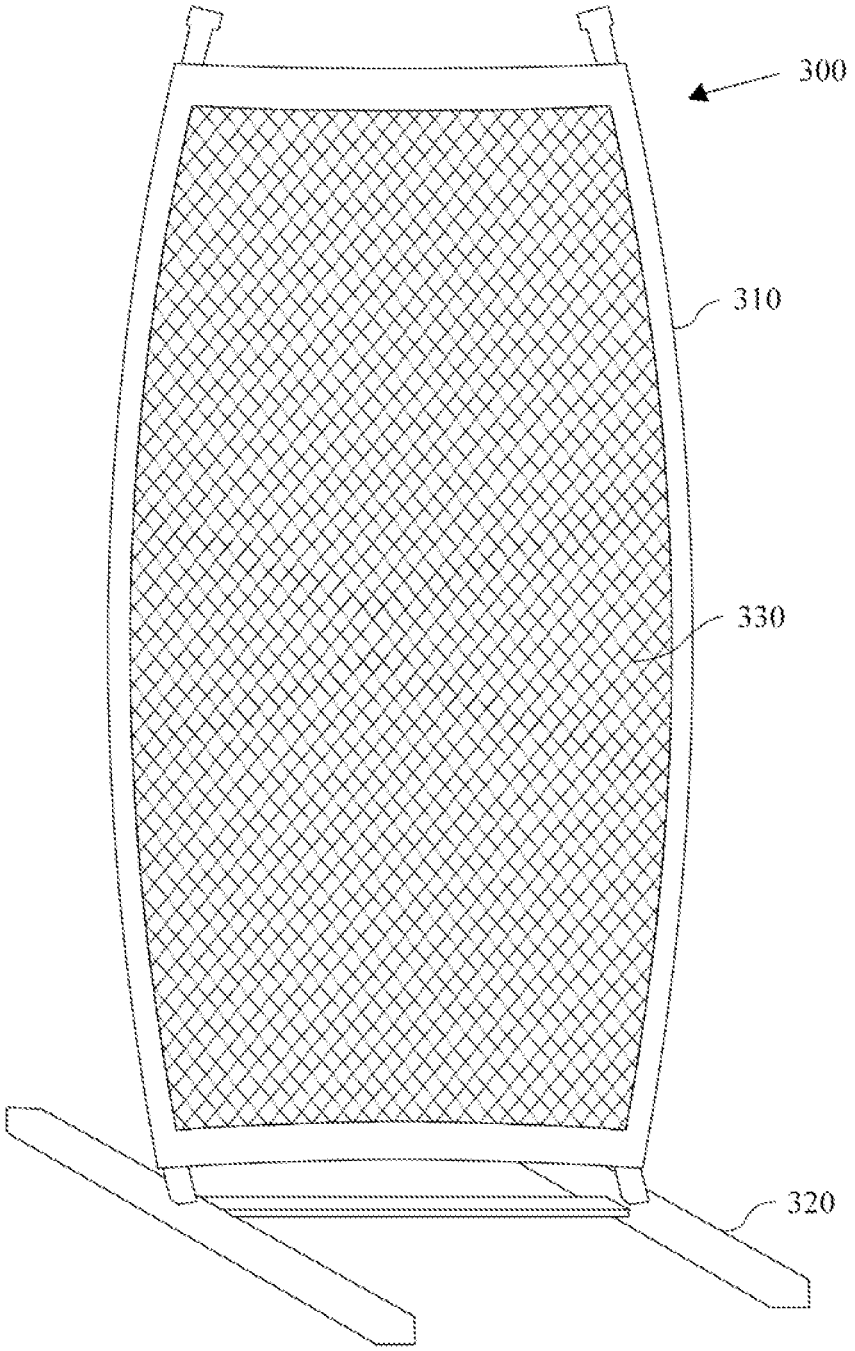
FIG. 3 is a mesh training device.

FIG. 3 depicts a training device 300 that includes a frame 310, a base 320, and a non-solid material 330. The non-solid material 330 in FIG. 3 is a larger mesh than used in training 200 in FIG. 2. It will be appreciated that the larger mesh in training device 300 provides increased visibility through though the training device compared to training device 200 in FIG. 2, which may allow a player to locate another player on the field more quickly and/or accurately. However, it will be appreciated that training device 300 does not instill any visual impression of a human (e.g., a soccer player, etc.), not even the profile, which may be desired by those who use training devices.

Figure 4:
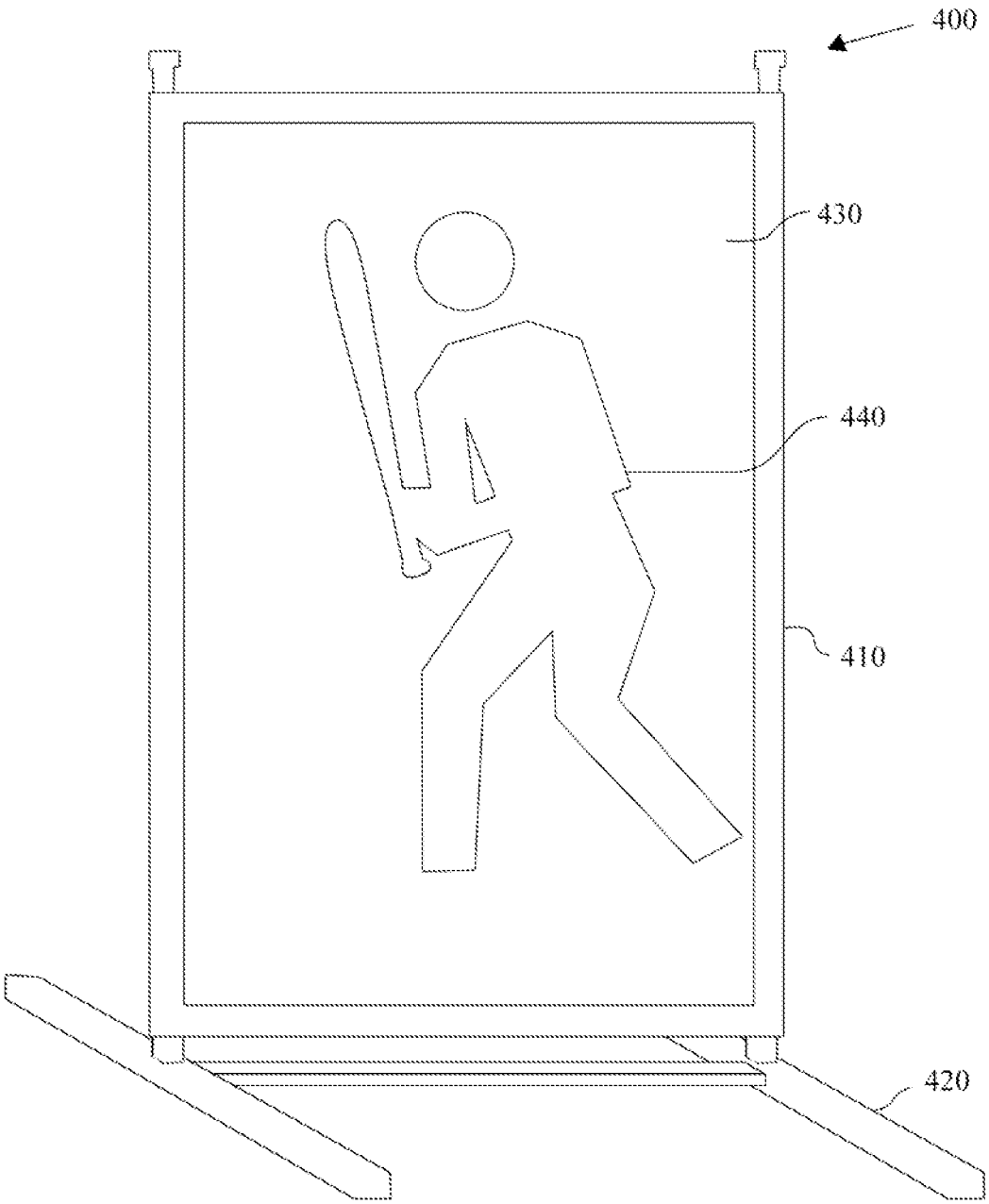
FIG. 4 is a solid material training device.

FIG. 4 depicts a training device 400 that includes a frame 410, a base 420, a solid material 430, and image 440. Material 430 is solid (e.g., such a nylon fabric of sufficient thread count to be opaque, and it is printed with and image 440 (e.g., an image of a sports figure). As training device 400 is opaque, a user cannot see though training device 400, thus may be dangerous to use on a playing field and it only suitable for target practice. For example, two players may be running towards training device 400, but they may not be able to see each other because material 430 is opaque, and thus, may collide with each other as they pass the training device causing injury. It will be appreciated that if an image (e.g., a human baseball player) is desired on both sides of training device 400, then each side of solid material 430 must be printed. While training device may include a very high restitution image, it remains undesirable in certain aspects because players cannot see though it.

Figure 5A:
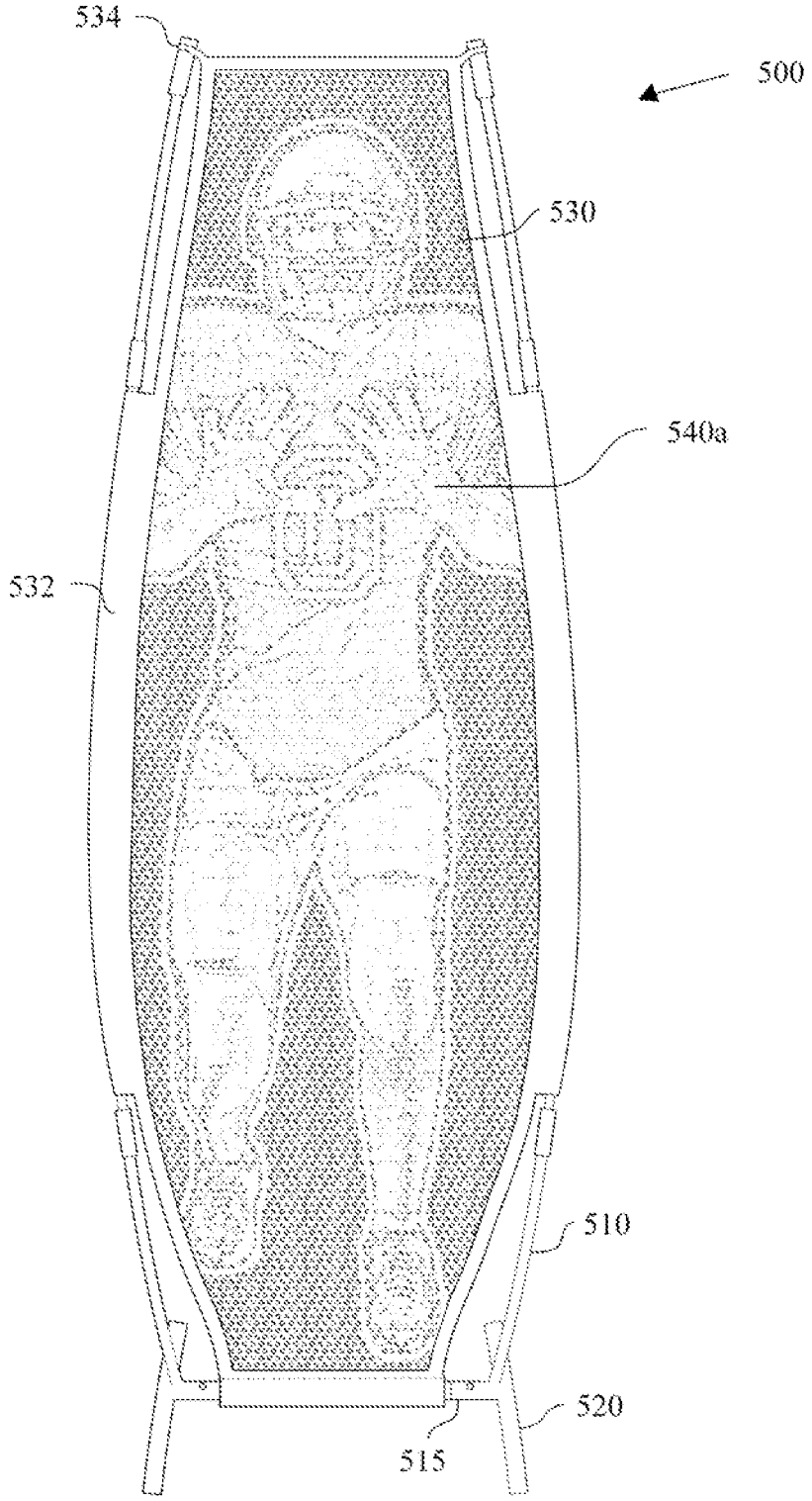
FIG. 5A is a front view of a training device in accordance with certain aspects of the present disclosure.
Figure 5B:
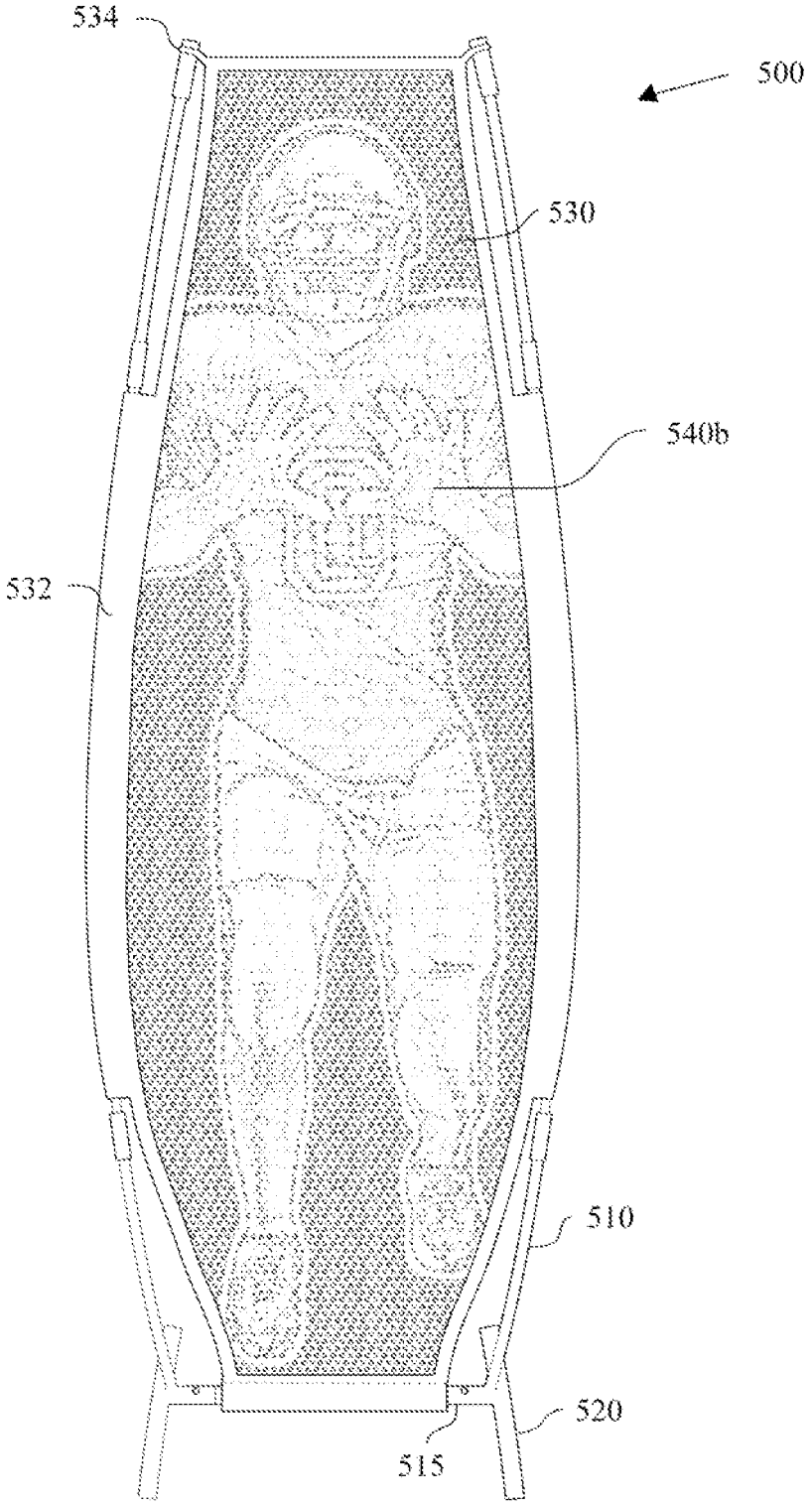
FIG. 5B is a back view of a training device in accordance with certain aspects the present disclosure.

As noted above, training devices 100, 200, 300 and 400 in FIGS. 1-4 all have drawbacks. Most notably, none of the training devices 100, 200, 300 and 400 in FIGS. 1-4 provide players with realistic imagery of an opponent while maintain the ability to see though the training device. It will be appreciated that the more realistic the imagery, the more useful the training device. FIG. 5A depicts a training device in accordance with certain aspects of the present disclosure that provides new and novel improvements to the training device market. As shown in FIG. 5A, training device 500 includes a frame 510, a base 520; a material 530 attached to the frame wherein the material 530 comprises a non-solid material having a first side and a second side. The first side is shown in FIG. 5A and the second side is shown in FIG. 5B. Image 540*a* is affixed to the first side of material, wherein the image 540*a* is viewable on the first side of the material 530 (as shown in FIG. 5A) and viewable on the second side of the material 530 as shown in FIG. 5B as image 540*b*.

Frame 510 may be of a number of different configurations (e.g., frame 210 in FIG. 2, frame 310 in FIG. 3, frame 410 in FIG. 4, or a number of other configurations suitable for displaying material 530 as disclosed herein). Frame 510 may be constructed of metal, plastic, carbon fiber, or another sufficiently rigid material suitable for displaying material 530 as disclosed herein. Frame 510 may use thin or thick bars of various shapes (e.g., thin cylindrical poles, thick square bars, etc.).

Base 520 may be of a number of different configurations (e.g., Base 220 in FIG. 2, Base 320 in FIG. 3, Base 420 in FIG. 4, or a number of other configurations suitable for supporting the frame as disclosed herein). Base 520 may further include an attachment means (not shown) for securing training device 500 to a playing surface (e.g., a baseball field, basketball court, soccer field, etc.) such as weighting the base, stakes, tiedowns, suction cups, etc.

Additionally, in certain embodiments, the base and the frame may share components (e.g., a portion of the frame may be included/referred to as a portion of the base, or a portion of the base may be included/referred to as a portion to the frame (e.g., base portion 515 may be referred to as frame 515 when it is used to support or anchor material 530). Base 520 may be constructed of metal, plastic, carbon fiber, or another sufficiently rigid material suitable for supporting frame 510 as disclosed herein.

Material 530 is a non-solid material (e.g., a synthetic or natural fiber mesh, netting, etc.) that is sufficiently non-solid so that a user can see through material 530 to detect the presence of an object on the other side of the training device (e.g., the playing field, another player, etc.). Material 530 has a first side (or front side as shown in FIG. 5A) and a second side (or back side as shown in FIG. 5B). Material 530 may be attached to frame 510 in a number of ways, such as using a material (e.g., a solid material or non-solid material sleeve) such as sleeve 532, which may be located on certain portions around the perimeter of material 530 thereby creating attachment points to attach to the frame. In certain aspects, hooks, ties, magnets, clips, rope (e.g., rope 534), hook and loop, or other fasteners may be used to attach material 530 to the frame. In certain aspects, more than one attachment design is used. In certain aspects, material 530 is substantially planar between the frame when properly assembled. It will be appreciated that in certain aspects material 530 is attached to the frame continuously around its perimeter, and in other aspects, a minimal number of attachment points may be used (e.g., 2, 3, 4, etc.).

Image 540*a* can be affixed to the first side of material 530 in a number of ways (e.g., by printing, painting, silk-screening, heat-transfer, etc.) without deviating from the scope of this disclosure.

As shown in FIG. 5B, image 540*a* is viewable from the second side of material 530 as image 540*b*, however, it will be appreciated that image 540*b* is not affixed to the second side of material 530, meaning only the front side of the material is affixed with image 540*a*. Thus, it will be appreciated that image 540*b* is the reverse of image 540*a*.

Figure 6:
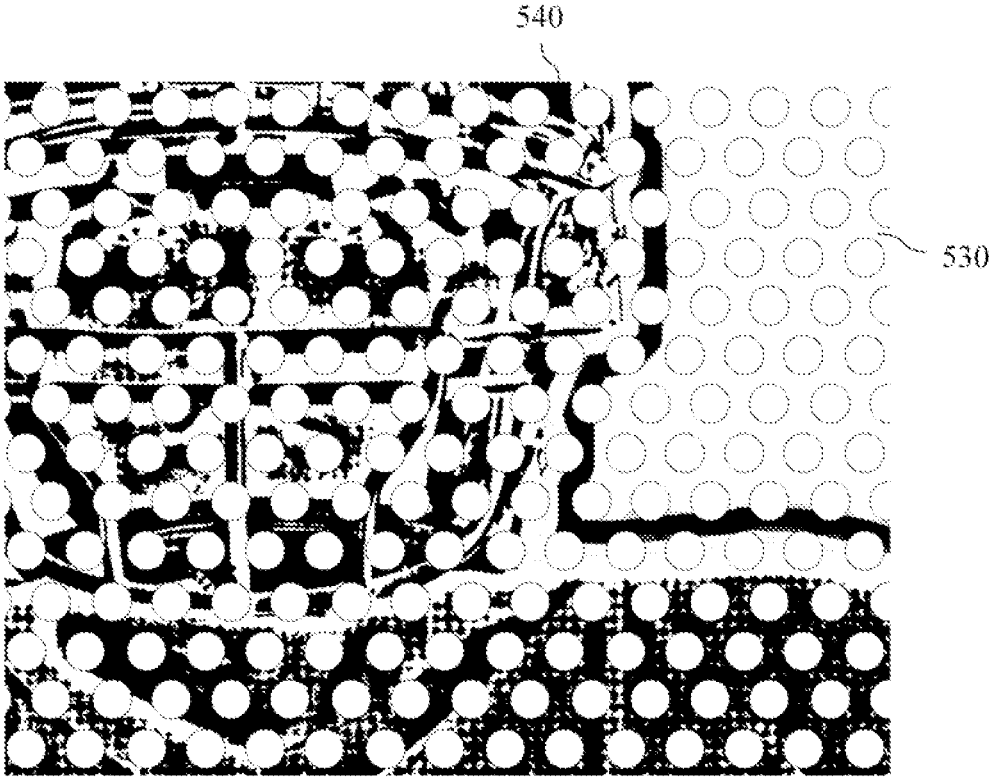
FIG. 6 is an enlarged view of a portion of a training device in accordance with certain aspects the present disclosure.

In certain aspects, the viewability of image 540 is in part due to the non-solid nature of the material. FIG. 6 depicts a portion of the front side of material 530 (image 540*a*) from FIG. 5A. It will be appreciated that material 530 may contain any number of non-circular holes (or airspace), and the airspace may be smaller or larger than is shown in FIG. 5A-FIG. 8B. For example, in certain aspects, the airspace in material 530 may comprise 50% of the volume of material 530. In other aspects, the airspace may comprise 75% of more of the material, but in other aspects, the airspace may comprise 25% or less of the material. It will be appreciated that while the image 540 may be slightly difficult to see at very close distances from the training device 500 as shown in FIG. 6, it will nevertheless be known that the image is readily apparent at optimal playing distances (e.g., 1 ft., 5 ft., 50 ft., etc.) from the training device.

Figure 7:
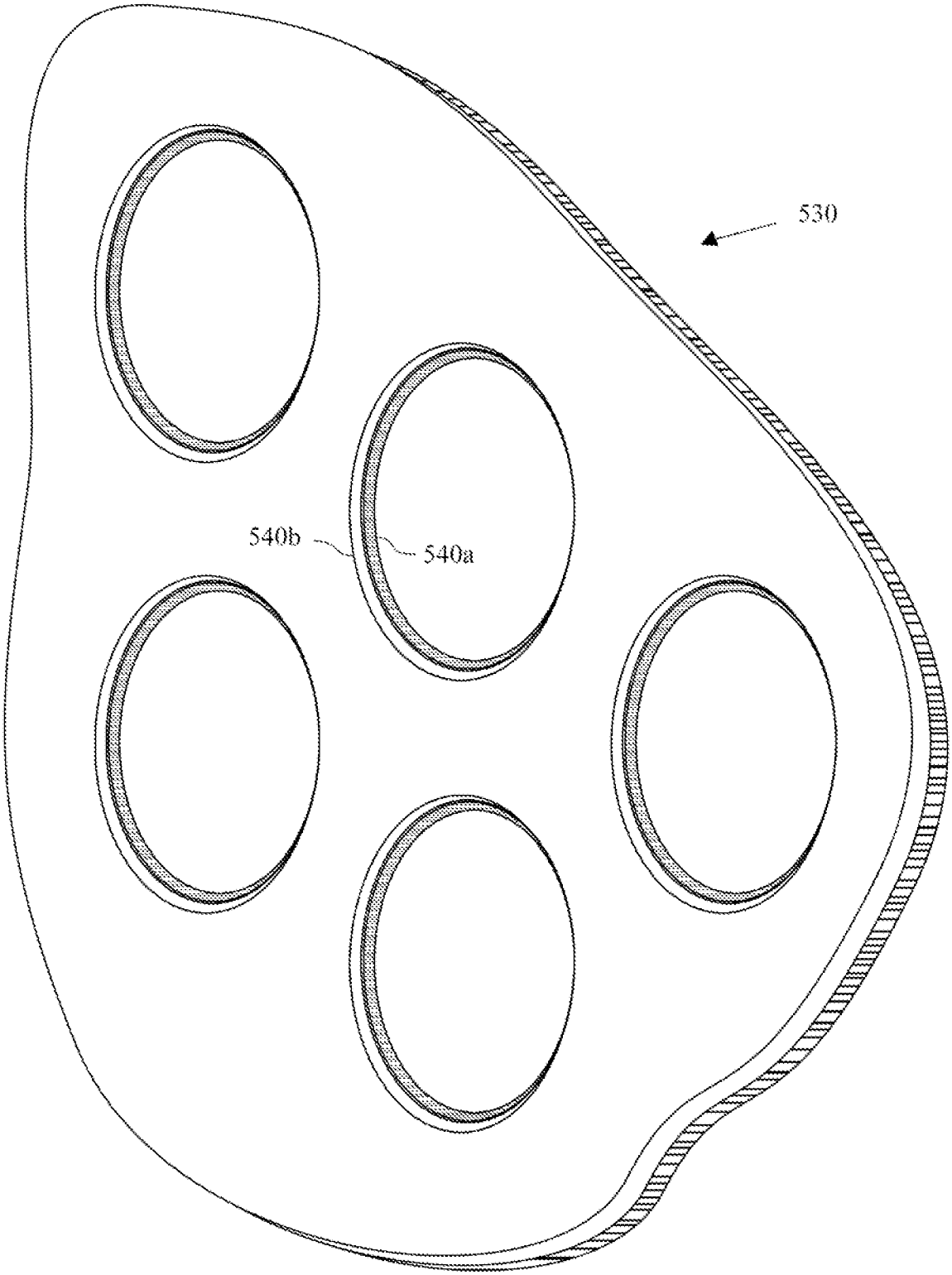
FIG. 7 is an enlarged view of a portion of a training device in accordance with certain aspects the present disclosure.

FIG. 7 shows a portion of material 530 from FIG. 5B. (i.e., the backside of training device 500), in which image 540*a* is affixed to material 530 on the front side of material 530 and no image is affixed to the back side, shown as image 540*b*. As shown in FIG. 7, portions of image 540*a* are viewable though material 530 creating image 540*b*. It will be appreciated that the image 540*a* may remain entirely on the front side of material 530 as shown in FIG. 7, or the image 540*a* may partially bleed through the material. In certain aspects material 530 may be a multilayered material or a single layer material, and image 540*a* may penetrate one or more layers such that on a white non-solid material, the image 540*a* may be visible through the material 530 itself. This may be the case when material 530 is not completely opaque (not shown).

In certain aspects, material 530 may be selected based on having a certain transparency level (i.e., the transparency of the matieral that make up material 530) may be adjusted. In certain aspects, the thickness of the non-solid material is selected based on how the user desires image 540*a* on the first side to be seen as 540*b* on the second side. For example, a two-layer mesh material may be selected for material 530, such as is shown in FIG. 7, and when affixing the image 540*a* on the first side the image 540*a* may saturate the fibers of the first layer of material 530 on the first side, but not the second layer on the second side. Saturation need not be uniform in all aspects. It will be appreciated that the image 540*a* will be viewable from the second side as image 540*b* even though the image is not affixed or saturated into the second side of material 530. In other aspects, the second layer is partially saturated.

It will be appreciated that training device 500 in FIGS. 5A and 5B can save printing costs compared to affixing image 540*a* and 540*b* on material 530 (e.g., such as in training device 400 in FIG. 4). The techniques disclosed herein may also double production and half of the printing costs compared to orienting on both sides of material 530.

Training device 500 in FIGS. 5A and 5B can be used to depict a human figure with a less complex frame than known training devices (e.g., training device 200 in FIG. 2). It will be appreciated that by affixing an image 540*a* to the first side of training device 500, the user of the training device can more easily visualize a realistic opponent compared to seeing the mere profile of a human (e.g., training device 200 in FIG. 2) as the image may show a sports specific image, such as a football player wearing shoulder pads and a helmet. This provides a substantial advantage as the improved visualization provided by training device 500 of an actual player will better prepare players for actual game play.

Figure 8A:
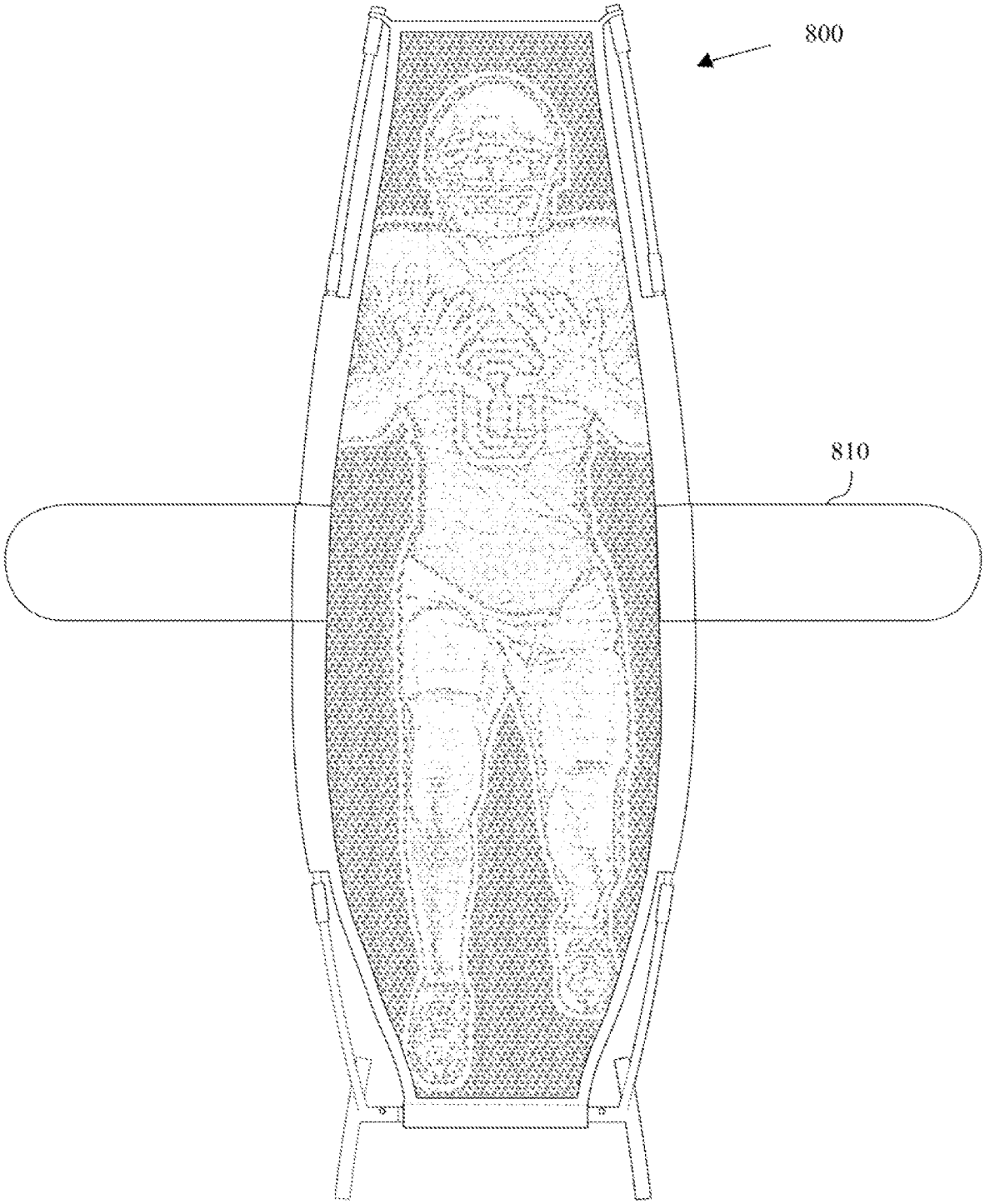
FIGS. 8A-8B show a front view of a training device in accordance with certain aspects of the present disclosure.
Figure 8B:
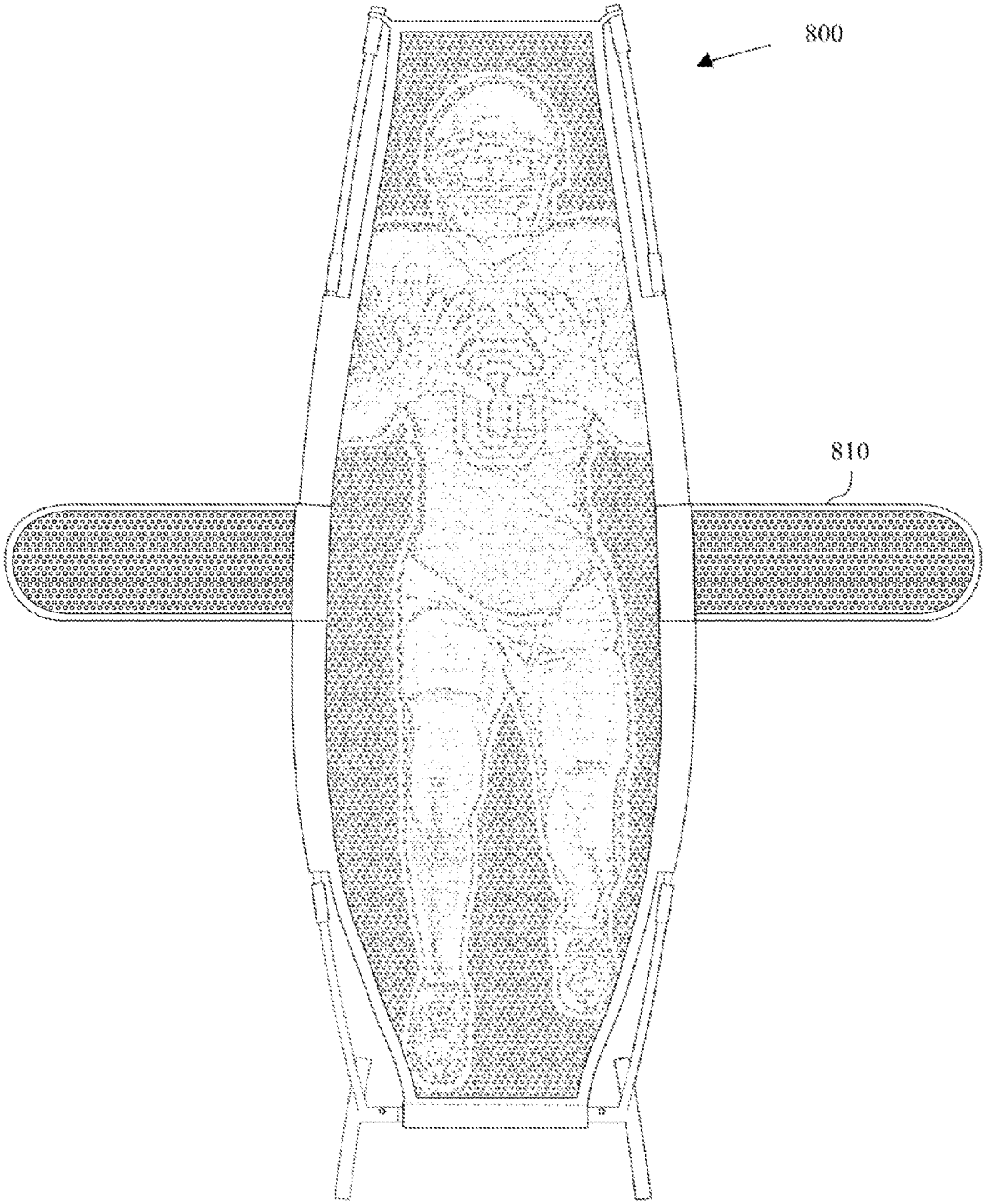

In certain aspects, a training device in accordance with the present disclosure may include modular training device attachments, such as shown in FIG. 8 for example. FIG. 8 shows training device 800 which includes attachments 810, for example, to increase the effective training area of device 800 and require players to navigate a larger area to navigate around. Attachments 810 may also use a non-solid material affixed with an image (not shown) or may be solid (e.g., foam, plastic, or a solid material such a high thread count nylon). Attachments may be attached to training device 800 in a number of means (e.g., buttons, snaps, clips, hook and loop, magnets, etc.) and may be designed as "break-away" attachments to fall off when impacted or "movable" such that attachments bend back allowing a player to move through attachments 810, or rigid such that attachments do not fall off or bend.

While the invention has been shown in only some of its forms, it should be apparent to those skilled in the art that it is not so limited, but is susceptible to various, changes and modifications without departing from the scope of the invention. Accordingly, it is appropriate that the appended claims be construed broadly and in a manner consistent with the scope of the invention.

What is claimed is:

1. A training device comprising:

a rigid structure including a base portion and a frame portion; and a flexible material coupled to the rigid structure; wherein:

the flexible material comprises a plurality of regularly spaced circular and/or non-circular holes disposed therein and an organic or synthetic fabric disposed between the plurality of circular and/or non-circular holes;

the organic or synthetic fabric comprises an image portion configured to be visible from a front side and a back side of the flexible material via a saturated marking of the image portion; and the image portion comprises a depiction of a realistic opponent comprising at least one non-profile feature.

2. The training device of claim 1, wherein the at least one non-profile feature of the image portion corresponds to a face of the realistic opponent.

3. The training device of claim 2, wherein the realistic image is a sports figure.

4. The training device of claim 3, wherein the sports figure comprises at least one of a basketball player, a baseball player, a football player, a soccer player, a hockey player, a lacrosse player, a rugby player, or a volleyball player.

5. The training device of claim 1, wherein the flexible material is a fabric.

6. The training device of claim 1, wherein the plurality of holes comprises 25% or less of the flexible material.

7. The training device of claim 1, wherein the flexible material comprises a multi-layered fabric.

8. The training device of claim 1, wherein the image portion comprises a target.

9. The training device of claim 1 further comprising an attachment supported by the frame portion and extending outward from the frame portion.

10. The training device of claim 9, wherein the attachment comprises an attachment image portion configured to be visible from a front side and a back side of the attachment via a saturated marking of the attachment image portion.

11. The training device of claim 1, wherein the flexible material comprises one or more fasteners configured to couple the flexible material to the rigid structure.

12. The training device of claim 11, wherein the one or more fasteners comprises a sleeve engaging the base portion.

13. The training device of claim 11, wherein the one or more fasteners comprises a first sleeve and a second sleeve engaging a first side and a second side of the frame portion, respectively.

14. The training device of claim 11, wherein the one or more fasteners comprise one or more hooks, loops, ties, magnets, ropes, buttons, and/or clips.

15. The training device of claim 1, wherein plurality of holes comprises 10% or more of the flexible material, and wherein the flexible material comprises a nylon fabric, a fiber mesh, an at least semi-opaque or semi-transparent material, a see through material, or a multilayered or single layered fabric.

16. The training device of claim 1, wherein the plurality of holes comprises 50% of the flexible material.

17. The training device of claim 1, wherein the plurality of holes comprises 75% or more of the flexible material.

18. The training device of claim 10, wherein the attachment image portion corresponds to a realistic image.

19. The training device of claim 18, wherein the realistic image corresponds to a sports figure.

20. The training device of claim 19, wherein the sports figure comprises at least a portion of: a basketball player, a baseball player, a football player, a soccer player, a hockey player, a lacrosse player, a rugby player, and/or a volleyball player.

* * * * *